United States Patent [19]

Hedges

[11] Patent Number: 4,869,279

[45] Date of Patent: Sep. 26, 1989

[54] WALKER

[76] Inventor: Harry S. Hedges, 1612 Southern Ave., Kalamazoo, Mich. 49001

[21] Appl. No.: 944,983

[22] Filed: Dec. 22, 1986

[51] Int. Cl.[4] ..... A61H 3/00

[52] U.S. Cl. ..... 135/67; 272/703

[58] Field of Search ..... 135/67; 272/70.3; 297/5, 6

[56] References Cited

U.S. PATENT DOCUMENTS 3,387,618 6/1968 Swann ..... 135/67
4,211,309 7/1980 Ruggiero ..... 272/70.3

FOREIGN PATENT DOCUMENTS 54430 5/1950 France ..... 272/70.3
1105324 11/1955 France ..... 135/67
832913 4/1960 United Kingdom ..... 272/70.3
1048148 11/1966 United Kingdom ..... 272/70.3

*Primary Examiner*—Robert A. Hafer
*Assistant Examiner*—Charles H. Sam
*Attorney, Agent, or Firm*—Harry S. Hedges

[57] ABSTRACT

An invalid walker comprising right and left side frame members in the form of an inverted Y-shape, each frame member containing a vertical leg, a side leg attached downwardly and rearwardly from the vertical leg and a horizontal brace connecting the vertical leg and side leg, a front horizontal member connecting the right and left side frame members, and handgrip support attached to the upper end of each vertical leg. Stair climbing convenience is provided by a forward extension of the horizontal brace and a restraint strap between the handgrip supports provides an optional safety feature.

1 Claim, 7 Drawing Sheets

WALKER

BACKGROUND OF THE INVENTION

The individuals in society today have placed a great deal of emphasis on the need to remain as physically active as possible. The desire to be able to travel and do so many things with a minimum of physical restrictions and discomfort is still a primary objective for many individuals and this is certainly attainable with no difficulty for a large segment of our population. However, this is not a perfect world and a large number of individuals today find that they are unable to exert themselves without some physical restriction and discomfort. Thus for those individuals the goal of self-sufficiency becomes an increasing problem. This is particularly true of a large segment of our increasingly elderly population as well as those younger individuals who are physically unable to ambulate due to severe physical problems which affect their strength and muscular coordination, e.g., stroke victims as well as victims of severe arthritis or osteoporosis. Some of the individuals with physical ailments have to some degree benefited by the use of invalid walkers now available to them. The U-shaped walkers are generally quite conspicuous in restaurants, malls, rest homes and other public establishments. Thus these walkers have opened up a world to many individuals who would otherwise be homebound. Their mobility has greatly increased and along with this the pleasures of everyday living.

The U-shaped walkers have been available for many years. For example, U.S. Pat. Nos. 3,517,677 and 3,945,389 show the typical U-shaped walkers. U.S. Pat. No. 3,517,677 shows a design which permits relative rotation of the two side frames to permit usage of the walker on uneven surfaces. U.S. Pat. No. 3,945,389 shows a U-shaped walker with a transverse member and braces which permit the user to conveniently fold the walker when not in use.

Moreover, in order to provide some handicapped individuals with stair climbing ability, walker aids have been incorporated into canes and crutches to facilitate this type of physical movement. Thus, U.S. Pat. No. 3,387,618 discloses improvements to crutches and cane which permits the user to ascend and descend stairways. U.S. Pat. No. 4,094,331 shows a walking frame of novel design which presumably can be used on level surfaces as well as stairways. Thus, it has been the meritorious objective of inventors in this field to provide handicapped individuals with equipment which to a large extent avoids a life in wheelchairs, rest home or hospital beds. This has been accomplished to some degree by the use of U-shaped walkers. Now the present invention provides the user with a walker which is both novel in design and highly functional.

SUMMARY OF THE INVENTION

This invention relates to a novel invalid walker design. The presently available U-shaped walkers have certain construction disadvantages. For example, U-shaped side frames obviously require bending or shaping which adds to the production costs. In addition, whenever material is shaped, stress and fatigue problems do arise. The U-shaped side frames also add additional weight to the walker proper. The present invention eliminates material stresses and reduces production costs by virtue of an inverted Y-shaped side frame design which is considerably lighter than the conventional U-shaped walker using comparable construction materials.

The lighter weight and overall design of this novel walker permits easy manipulation by the user without loss of support or stability. The inverted Y-shaped construction of the invention also permits the use of removable interchangeable handles to accommodate the varied needs of the user. For example, the handle interchangeability permits those individuals with one weakened arm to utilize a walking aid device commonly known as a Canadian Cradle, i.e., an arm cradle, and the other unaffected arm could use a cane handle or some modification thereof.

The inverted Y-shaped walker also permits ready vertical adjustability to permit the walker to accommodate individuals, adults and children of different sizes.

For stairway use the U-shaped walker presents problems to those users who are generally in a weakened muscular condition since the user must by necessity lift the walker two steps for each step traversed. The present novel walker with an attached step traversing feature permits the user to ascend a stairway by lifting the walker one step for each step traversed. Thus, the handicapped user is not compelled to expend the energy and relinquish stability to vertically lift the walker the additional step for each step traversed.

BRIEF DESCRIPTION OF THE DRAWINGS

In the drawings which are to be regarded as merely illustrative.

DESCRIPTION OF THE PREFERRED EMBODIMENT

Figure 1:
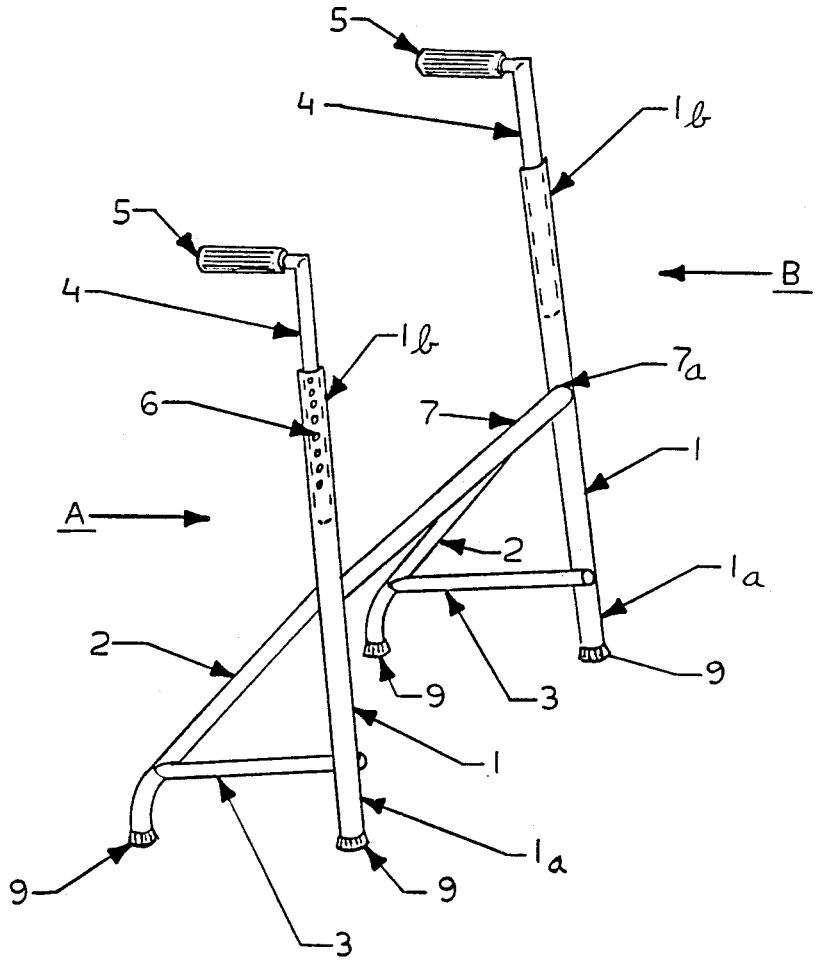
FIG. 1 is a perspective view of the basic novel walker without the step traversing feature.

FIG. 1 illustrates the novel walker comprised of inverted Y-shaped side frame members A and B. The side frame members A and B are structurally composed of vertical leg 1 where the lower end 1*a* of leg 1 is on ground surface contact. The other element of the inverted Y-shaped side frame is side leg 2 which is connected to vertical leg 1 in such a way that side leg 2 extends downwardly and rearwardly from vertical leg 1. Thus the intersection of vertical leg 1 and side leg 2 form a triangle wherein the angular dimension can be varied but it is generally preferred that the angle be such that the horizontal distance between vertical leg 1 and side leg 2 be no less than about thirteen inches where surface or ground contact is made by the two legs. Side leg 2 is connected to vertical leg 1 in any conventional non-movable manner, e.g., the two legs can be welded or side leg 2 can be shaped at the point of attachment to vertical leg 1 so that a nut and bolt arrangement or rivets can be employed to solidly secure the two leg members. In view of a non-movable connection between vertical leg 1 and side leg 2, the walker can be modified by connecting vertical leg 1 and side leg 2 with a hinge mechanism. This type of connection would facilitate storage of the walker when not in use.

Vertical leg 1 provides the main support for the invalid user in this novel walker and for this reason vertical leg 1 should be so positioned in the side frames A and B so as to minimize the possibility of forward tipping when the walker is in use. In actual use the walker is vertically raised as the user prepares to move forward and then placed on surface or ground contact. At this point the invalid user places a downward thrust on vertical leg 1 while the user again moves forward. In view of this significant downward thrust by the user and to minimize forward tipping of the walker the position of vertical leg 1 in side frame members A and B under some conditions is somewhat significant. The side frame members A and B could be constructed so that vertical leg 1 is in a perfectly vertical position. With a careful user no significant forward tipping problems would occur. However, in order to minimize this possibility, vertical leg 1 can be positioned rearwardly from surface contact no less than three degrees from the vertical position. With this angular position the possibility of forward tipping of the walker would be held to a minimum.

In order to add to the rididity of the side frame members A and B a horizontal brace 3 is connected to the side leg 2 and vertical leg 1. The horizontal brace 3 can be attached to side leg 2 and vertical leg 1 by means of a welded joint or with a nut and bolt arrangement or rivets, if so desired. Horizontal brace 3 can be connected to vertical leg 1 and side leg 2 at most any point on the legs to achieve stability and strength of the side frame members A and B.

Figure 2:
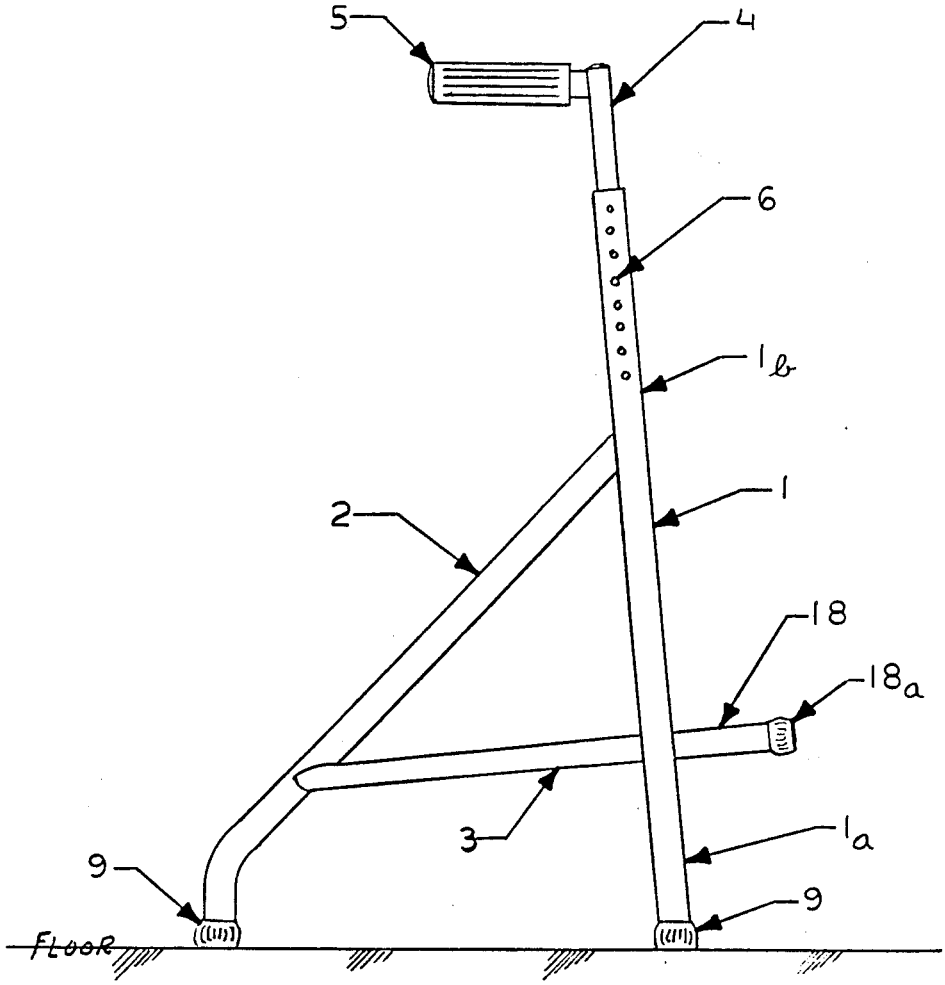
FIG. 2 is a side view of the novel walker.

As shown in FIGS. 1 and 2 the upper end 1b of vertical leg 1 is utilized to lock handgrip support 4 at a convenient height for the invalid user. This can be accomplished in a variety of ways. For example, vertical leg 1 can be tubular in cross section with an adequate number of openings 6 spaced longitudinally along the upper end 1b of vertical leg 1. Handgrip support 4, also tubular in cross section, can fit telescopically into vertical leg 1 and with a detent means in handgrip support 4 provide a means for height adjustment of the novel walker. The handgrip support 4 is readily raised or lowered simply by actuating the detent means and fitting the detent into the desired openings 6. Obviously other means for adjusting the handgrip support 4 at the desirable height in lieu of the detent means could include, e.g., a simple nut and bolt arrangement.

A silencer ring for noise suppression and increased rigidity, if needed, can be fitted onto the top of vertical leg 1, if so desired, by sliding means to minimize or eliminate undesirable play or lateral movement of the handgrip 4 telescopically fitted into vertical leg 1. To accomplish this, handgrip support 4 slides through a silencer ring with close tolerances and, after vertical adjustment of the handgrip support to the proper height, the silencer ring is slid onto vertical leg 1.

Figure 6:
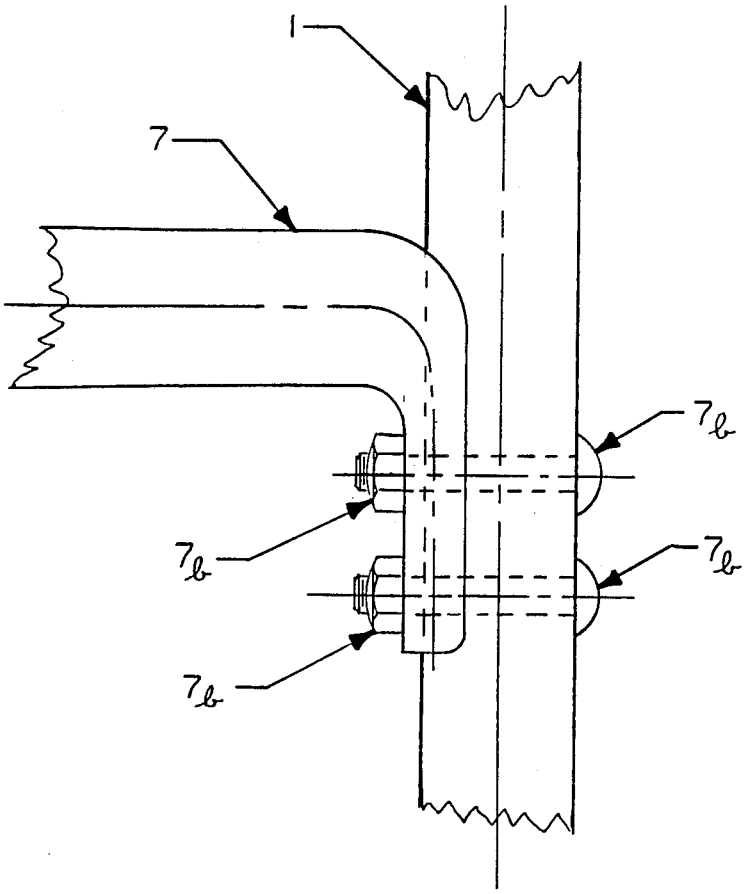
FIG. 6 is a fragmentary front elevational view showing one embodiment of how the vertical leg and front horizontal member may be connected.

The side frame member A and B are joined together by front horizontal member 7 which can be connected to vertical leg 1 of side frame members A and B in any suitable manner. As shown in FIG. 1 the connection may be a weld connection *7a* or if tubing is utilized the front horizontal member 7 can be shaped and flattened and then connected to vertical leg 1 by bolts *7b* as shown in FIG. 6.

The height of the front horizontal member 7 with respect to the ground level is significant when the walker is utilized over the standard size toilet bowls. The invalid users would obviously be much more comfortable if they could maneuver the walker over and around the toilet bowl with as little effort as possible. With this purpose in mind the side frame members A and B should be a minimum of about seventeen inches apart and the front horizontal member 7 should be at least sixteen inches from the floor level. It is obvious that these dimensions are not significant if use of the novel walker is limited to its use as a walking aid only e.g., in physical therapy training sessions.

In order to minimize slippage on icy, wet or slippery surfaces vertical leg 1 and side leg 2 are fitted with a slip-on foot pad 9, preferably of an elastomeric material.

Figure 5:
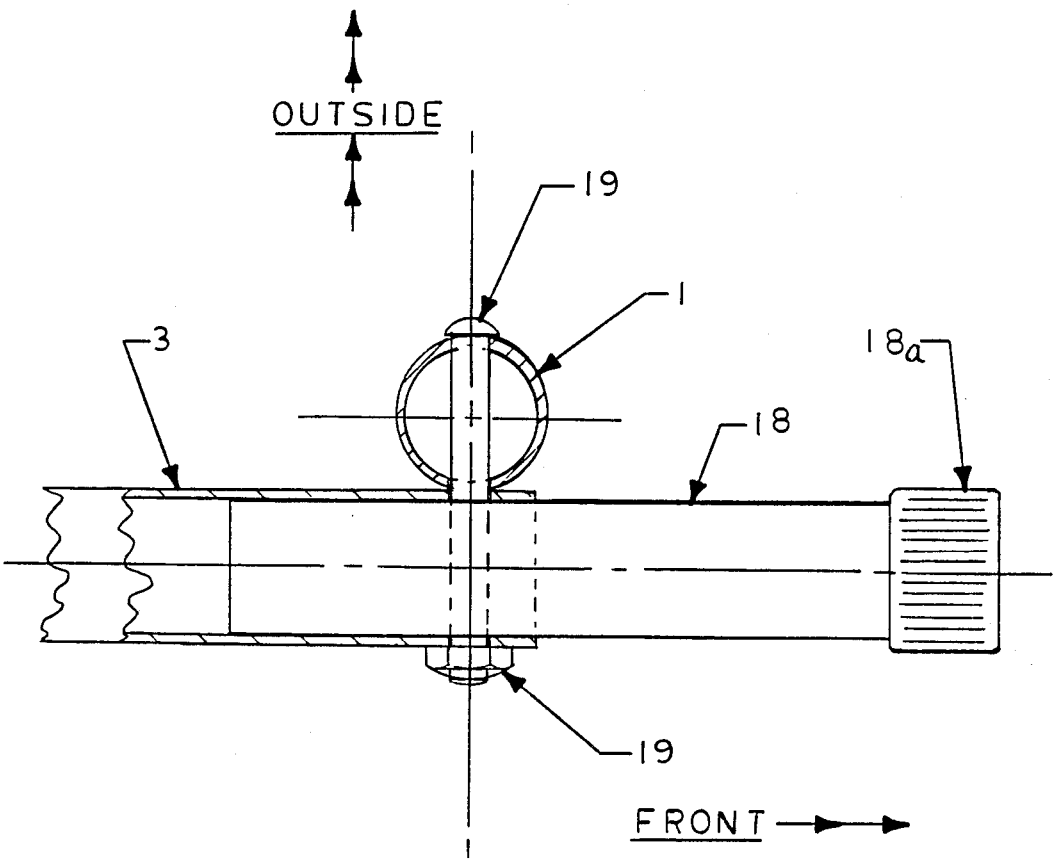
FIG. 5 is a fragmentary sectional view showing how the stair traversing member may be connected to the vertical leg.

FIGS. 2 and 5 show a modification of the basic novel walker shown in FIG. 1 One of the difficulties encountered by invalids is the simple physical movement of ascending and descending a stairway. This is particularly true of those individuals who are heavily dependent on a walker for all ambulatory assistance. To provide this assistance horizontal brace 3 can be modified by attaching stair leg 18 to the horizontal brace 3. The stair leg 18 should extend beyond vertical leg 1 a distance of about three inches so that solid contact with the stair tread is maintained and should be at a height of no more than seven inches from ground or surface contact. Stair leg 18 can be attached to vertical leg 1 most readily by utilizing metal tubing, e.g., steel or aluminum, and telescopically fitting stair leg 18 into the horizontal brace 3 as shown in detail in FIG. 5. The horizontal brace 3 and attached stair leg 18 can then be jointly secured to vertical leg 1 by means of a nut and bolt arrangement 19. Stair leg 18 can also be constructed as an integral part of horizontal brace 3. With such construction horizontal brace 3 would extend about three inches forward of vertical leg 1. This extension would be stair leg 18. This single piece construction provides the strength and stability as previously mentioned. As with the telescopic construction the single piece construction can be secured to vertical leg 1 by means of a nut and bolt arrangement, rivets or the integral member can be welded to vertical leg 1, if so desired. The user in ascending a stairway would simply lift the walker so that the stair leg 18 lies flat onto the next ascending stair tread and thus provides the user with the walker support needed to ascend the stairway. In descending the stairway the walker is reversed by the user so that the stair leg 18 is now to the rear or toward the user and thus provides the support needed to descend the stairway. Stair leg 18 is generally capped with an elastomeric tip 18a to minimize scratching and to provide a non-sliding surface.

Figure 3:
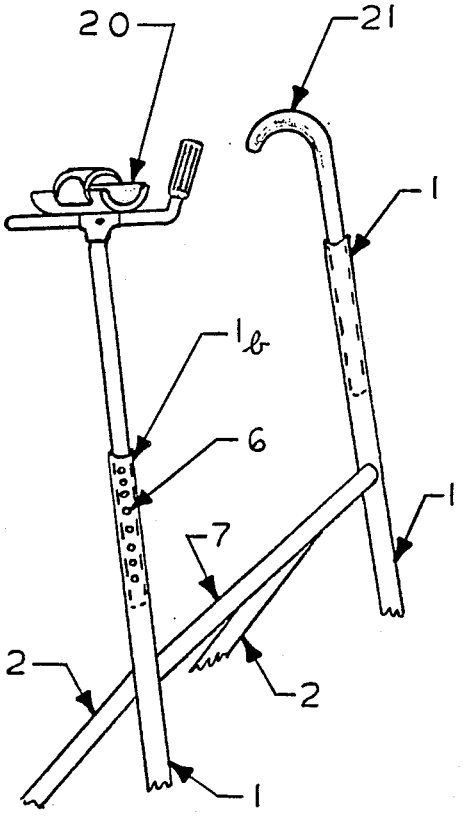
FIG. 3 and 4 are perspective views of representative alternative handgrip supports.
Figure 4:
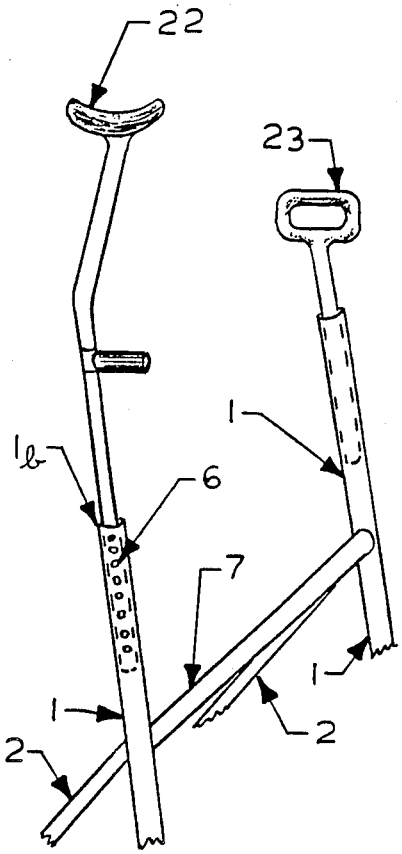

FIGS. 3 and 4 show typical alternate handgrip supports that may be utilized in lieu of handgrip support 4. These supports obviously would be used by individuals with different and varying degrees of disabilities. The varied handgrip supports connect to vertical leg 1 as previously explained in the discussion of handgrip support 4 in FIG. 1. Arm and hand support 20 (also commonly referred to as a Canadian Cradle) could be employed by a stroke victim with muscle weakness on only one side. In view of this hand and arm support 20 could be deployed along with a hook type handgrip 21 or a ring type handgrip 23 to provide the disabled user with the necessary support so that the user could continue to be ambulatory. Crutch support and handgrip 22 is another example of a handgrip support that could be employed with this novel walker. Crutch support and handgrip 22 could be employed by an individual who has suffered an amputation or who may have a severely arthritic hip. Thus it is readily apparent that any combination of handgrip supports could be employed with this novel walker so as to assist the user as much as possible.

Figure 7:
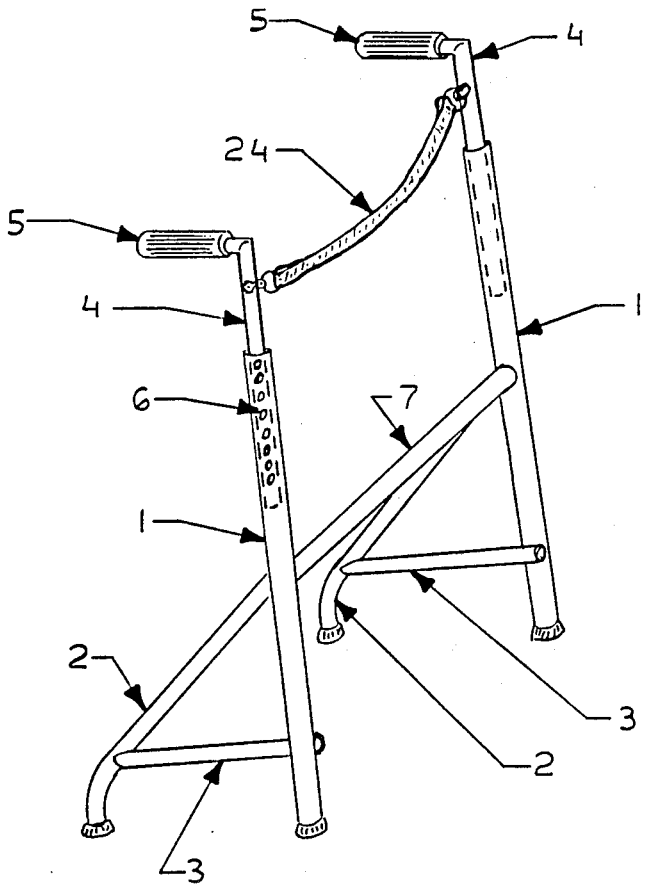
FIG. 7 is a perspective view of the novel walker with an optional restraint device for a patient safety.
Figure 7A:
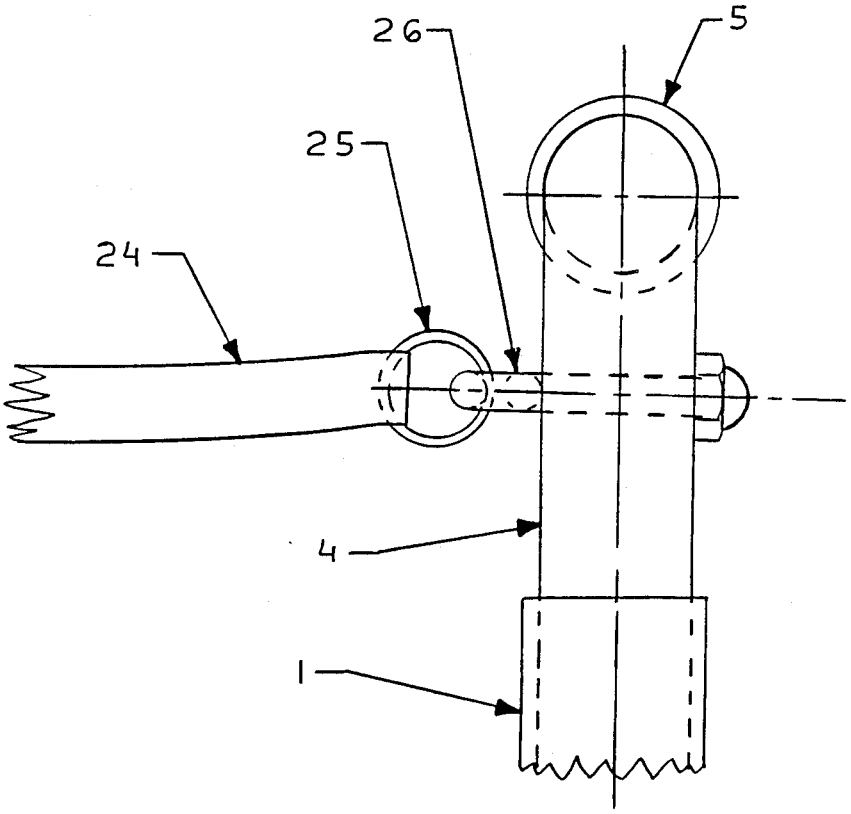
FIG. 7A is a fragmentary sectional view showing how the optional restraint device may be connected to the handgrip support.

FIGS. 7 and 7A show an optional safety feature that might be required by some individual users. Some individuals because of their disability are not quite as steady on their feet as others and thus would prefer a restraining strap as a safety feature between the side frame members A and B to break a forward fall and thus minimize the damage such a fall could cause. This would obviously provide them with a greater peace of mind. More specifically, this safety feature as shown in FIGS. 7 and 7A is represented by a restraint strap 24 detachably connected to the upper end of handgrip support 4 by means of various conventional fastening devices. For example, in FIG. 7A support ring 25 and strap eyelet 26 jointly provide the needed connecting mechanism. Strap eyelet 26 is attached to the uppermost section of handgrip support 4 so as not to interfere with the vertical adjustability of handgrip support 4. The restraint strap 24 is made of leather or any synthetic fiber, e.g., nylon. The support ring 25 is fastened to the restraint strap 24 in any conventional manner since restraint straps are widely used in many areas and such technology is readily adaptable for use herein. Obviously the restraint strap can be removed whenever desired by means of the simple support ring 25 and strap eyelet 26 interconnection. Thus, strap 24 can be permanently secured to one side frame member and detachably connected to the other side frame member or, in the alternate, strap 24 could be detachably connected to both side frame members.

It should be appreciated that modifications of this basic novel structure by individuals skilled in the manufacture of walkers would be apparent upon the reading of this description. It is the intent herein to include all modifications as they come within the scope of appended claims and equivalent theory.

I claim:

1. An invalid walker comprising:

right and left side frame members, each frame member containing a vertical leg positioned rearwardly from surface contact no less than three degrees from the vertical position for optimum user stability, a side leg attached downwardly and rearwardly to vertical leg so that the vertical and side leg are in ground or surface contact, and a horizontal brace connecting the vertical and side leg;

wherein the horizontal braces are tubular in cross section and wherein stair legs are provided to assist the invalid user when ascending and descending a stairway while the stair legs are in contact with a stair tread wherein each stair leg is tubular in cross section and telescopically fits into the tubular horizontal brace and projects forward of the vertical leg a distance of about three inches and is fixedly secured to the vertical leg at a height of no more than about seven inches from ground or surface contact;

a front horizontal member connecting the right and left side frame members at a height of no less than about sixteen inches from ground or surface contact;

a vertically adjustable handgrip support means attached to the upper end of the vertical leg of each side frame member to permit the invalid user to lift the invalid walker and move forward with the invalid walker;

a restraint strap detachably connected between the upper end of the handgrip supports of each frame member;

and wherein said horizontal brace is attached to the vertical leg and the side leg at an adequate height from ground or surface contact to provide rigidity to the right and left side frame members when downward thrust is exerted on the handgrip supports by the invalid user.

* * * * *
* * * * *